US005157850A

United States Patent [19]

Terng-Shuh

[11] Patent Number: 5,157,850

[45] Date of Patent: Oct. 27, 1992

[54] SOLE DRYER

[76] Inventor: You Terng-Shuh, No. 95, Gwo Sheng 8th Street, Hualian, Taiwan

[21] Appl. No.: 805,054

[22] Filed: Dec. 11, 1991

[51] Int. Cl.[5] ..... F26B 19/00

[52] U.S. Cl. ..... 34/202; 392/365; 392/379; 392/380

[58] Field of Search ..... 34/90, 202, 218; 392/351, 365, 379, 380

[56] References Cited

U.S. PATENT DOCUMENTS 3,711,958 1/1973 LePage ..... 392/380 X 4,677,764 7/1987 Cerny ..... 34/202 X 5,007,182 4/1991 Fishman ..... 392/380 X

*Primary Examiner*—Robert G. Nilson

*Attorney, Agent, or Firm*—Morton J. Rosenberg; David I. Klein

[57] ABSTRACT

A sole dryer comprising two electric air blowers respectively controlled by two trigger switches to blow heated air currents for drying the soles of the legs placed on a cover thereof, and a plurality of supporting spring means to automatically push said cover back to its original position so as to disconnect said trigger switches after the removal of said legs from said cover.

1 Claim, 2 Drawing Sheets

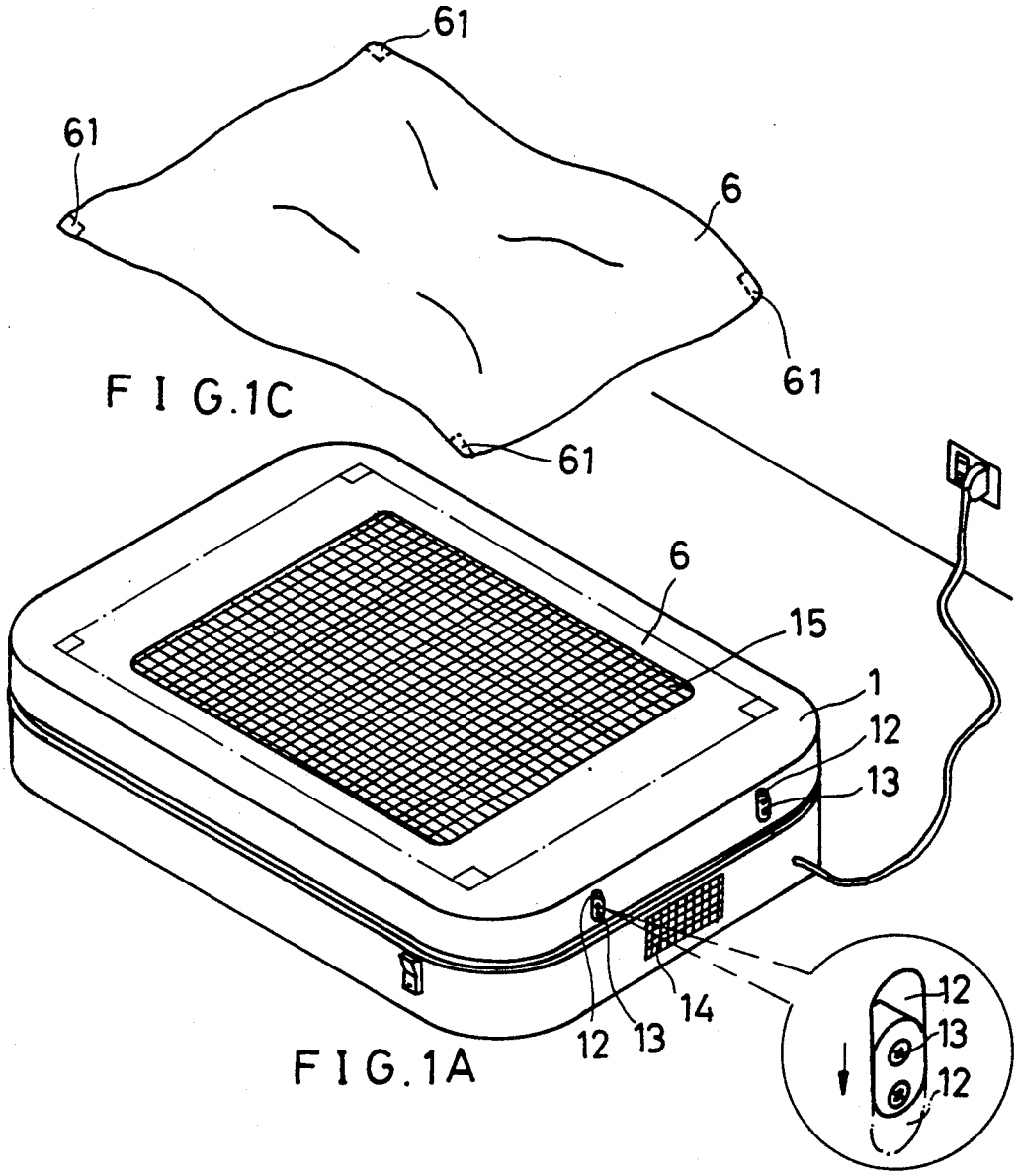
FIG.1C
FIG.1A
FIG.1B
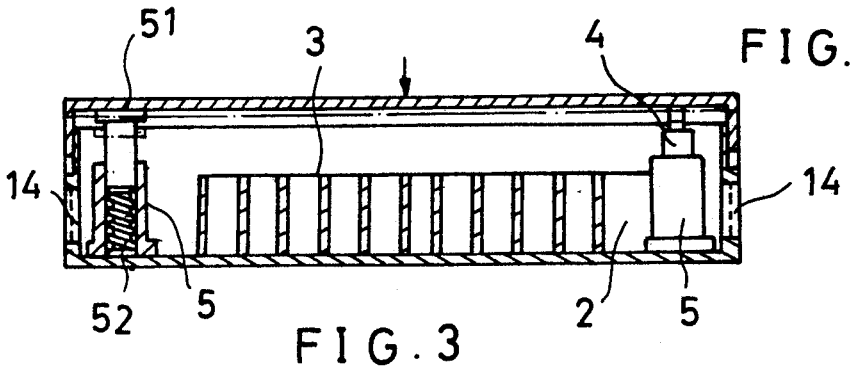
FIG.3

SOLE DRYER

BACKGROUND OF THE INVENTION

The present invention relates to a sole dryer for drying the sole of the foot which operates automatically when the legs are placed on the cover thereof for drying, and stops the operation immediately upon the removal of the legs from the cover.

After having a bath or the washing of the legs, the soles of the legs must be properly dried so as to eliminate possible contamination or and prevent from contracting a foot disease. A towel or an electric dryer may be used in drying the legs. Using a towel to clean the legs can not completely dry the soles and the toes of the legs. Using an electric dryer can dry the soles and toes of the legs, however, it is not comfortable to a fat person to bend the body and the legs for a certain length of time during the operation of sole drying.

SUMMARY OF THE INVENTION

The present invention has been accomplished in view of the aforesaid circumstances. It is therefore the main object of the present invention to provide a sole dryer which is practical and comfortable in use. According to the present invention, there is provided a sole dryer which is generally comprised of a cover covered on a base. The base has electric air blowers to produce heated air currents for drying the soles of the legs. Spiral grooves are made inside the base to uniformly distribute the heated air currents through a ventilation port on the cover. Two trigger switches are connected to turn on the electric air blowers automatically when the legs to be dried are placed on the cover. Supporting spring means are provided to automatically disconnect the trigger switches upon the removal of the legs from the cover.

BRIEF DESCRIPTION OF THE DRAWINGS

FIG. 1 is a perspective view of a sole dryer embodying the present invention;

FIG. 3 is a side sectional view thereof.

DETAILED DESCRIPTION OF THE PREFERRED EMBODIMENT

Figure 2:
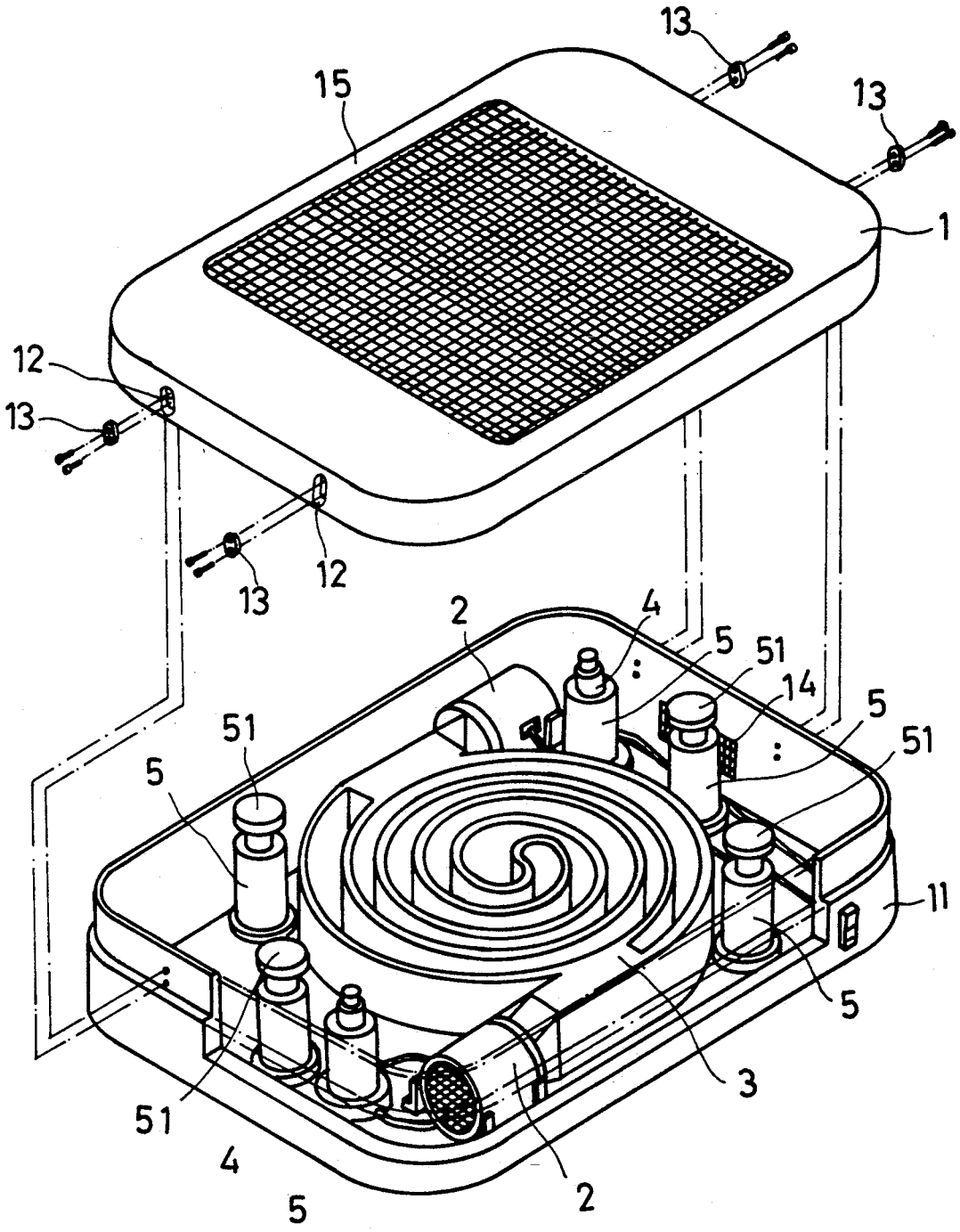
FIG. 2 is a dismantled perspective view thereof.

Referring to FIGS. 1, 2 and 3, two spiral grooves 3 are concentrically arranged inside a base 11 and respectively connected to opposite electric air blowers 2. Six tubes 5 are respectively fastened inside the base 11 in vertical positions. Among the tubes 5, there are two tubes attached with trigger switches 4 for controlling the operation of the electric air blowers 2 respectively. Each of the other four tubes has a spring 52 fastened therein to support a push bolt 51. There is provided a cover 1 covered on the base 11. The cover 1 has a plurality of holes 12 around the peripheral wall surface thereof, each of which is inserted with a locating element 13 for securing the cover 1 to the base 11 by fastening elements, and a ventilation opening covered with a wire mesh 15. Further, the base 1 also has at least one ventilation port 14 for convection of air current, and an electric circuit for connecting the electric air blowers 2 to an electric power supply via the trigger switches 4.

When in use, an air permeable paper 6 may be attached to the cover 1 over the wire mesh 15 by double-sided adhesive tapes 61. Once the legs are placed on the air permeable paper 6, wire mesh 15 is stretched downwards causing the trigger switches 4 to be simultaneously connected, and therefore, the electric air blowers 2 are simultaneously turned on. The heated currents of air from the electric air blowers 2 are delivered through the wire mesh 15 to dry the soles of the legs. When the legs are removed from the sole dryer after each use, the push bolts 51 are forced by the springs 52 to move the wire mesh 15 back to its original shape, and therefore, the trigger switches 4 are disconnected to turned of the electric air blower 2.

What is claimed is:

1. A sole dryer comprising a base covered with a cover, said cover having a ventilation opening at the middle covered with a wire mesh, said base having a plurality of supporting spring means to support said cover in position, two spiral grooves concentrically arranged below said wire mesh, two electric air blowers at two opposite locations controlled to blow heated air currents toward said wire mesh through said spiral grooves, and two trigger switches being to connect said electric air blowers to an electric power supply, and wherein placing the legs on said cover causes said trigger switches to turn on said electric air blowers respectively; said trigger switches are connected, when the legs are placed on said cover, to turn on said electric air blowers respectively; said trigger switches are disconnected by means of the operation of said supporting spring means, when the legs are removed from said cover, to turn off said electric air blowers respectively.

* * * * *